US007531041B2

(12) United States Patent
Davis

(10) Patent No.: US 7,531,041 B2
(45) Date of Patent: May 12, 2009

(54) BOWLING LANE CONDITIONING MACHINE HAVING CAM-ACTUATED WICK SEGMENTS

(75) Inventor: Mark E. Davis, Sebring, FL (US)

(73) Assignee: Kegel, LLC, Lake Wales, FL (US)

( * ) Notice: Subject to any disclaimer, the term of this patent is extended or adjusted under 35 U.S.C. 154(b) by 358 days.

(21) Appl. No.: 11/181,277

(22) Filed: Jul. 14, 2005

(65) Prior Publication Data

US 2007/0012247 A1 Jan. 18, 2007

(51) Int. Cl.
*B05C 11/00* (2006.01)

(52) U.S. Cl. ..... 118/268; 118/260

(58) Field of Classification Search ..... 15/98, 15/320, 103.5; 118/268, 260, 207, 244, 696, 118/706, 708
See application file for complete search history.

(56) References Cited

U.S. PATENT DOCUMENTS 3,150,407 A * 9/1964 Mitchell ..... 401/21
5,161,277 A 11/1992 Ingermann et al.
5,181,290 A 1/1993 Davis et al.
5,274,871 A 1/1994 Smith et al.
5,619,240 A * 4/1997 Pong et al. ..... 347/103
5,729,855 A 3/1998 Davis
6,685,778 B2 2/2004 Davis et al.

* cited by examiner

*Primary Examiner*—Brenda A Lamb
(74) *Attorney, Agent, or Firm*—Hovey Williams LLP

(57) ABSTRACT

A bowling lane maintenance machine utilizes flexible wick segments to transfer lane dressing to the applicator roll of the machine. The wick segments are caused to flex into and out of contacting engagement with a transfer roll associated with the applicator roll by rotatable cams that engage cam followers associated with the wick segments. The cams are all secured to a common cam shaft and are rotated in unison through successive short segments of rotational travel by an indexing motor that responds to a controller. Each wick segment has at least one spring that urges the segment into contacting engagement with the transfer roll, while the cam for that segment is disposed to engage the follower and flex the wick segment off the transfer roll against the action of the spring when the lobe of the cam is in contacting engagement with the follower.

9 Claims, 6 Drawing Sheets

BOWLING LANE CONDITIONING MACHINE HAVING CAM-ACTUATED WICK SEGMENTS

TECHNICAL FIELD

The present invention relates to bowling lane maintenance machines of the type that apply conditioning dressing to the surface of the lane and, more particularly, to improvements in the manner of controlling the actuation of wick segments used in the delivery of dressing to the lane.

BACKGROUND AND SUMMARY

Conditioning machines that deliver lane dressing to the applicator roll using flexible wick segments are well-known in the art. See, for example, U.S. Pat. Nos. 5,181,290 and 6,685,778, both of which are assigned to the assignee of the present invention. The wick segments in the machines of those two patents are arranged in a row or series beside a metal transfer roll associated with the applicator roll and are flexed independently onto and off of the transfer roll in a controlled manner that is coordinated with the distance traveled by the machine along the lane so that a preselected dressing pattern can be applied to the lane surface. Each of the wick segments is manipulated by its own solenoid-actuated device which in turn is controlled by a programmed control system that determines which of the wick segments are contacting the transfer roll, and when.

The present invention contemplates a wick-type delivery system wherein the wick segments are actuated by a series of cam actuators, rather than solenoid-actuated devices. In a preferred embodiment the cam actuators are all fixed to a common cam shaft that is rotatably indexed through successive partial revolutions by a motor controlled by a controller. All of the cam actuators rotate in unison during each actuation of the motor, but some of the cams are configured to lift their corresponding wick segments off the transfer roll at a particular distance along the lane, while others are configured to keep their wick segments in dressing-delivering contact with the transfer roll. Subsequent brief actuations of the motor cause additional cams to lift their wick segments off the transfer roll until, finally, in a preferred embodiment, all wick segments are disengaged from the transfer roll such that no more dressing is delivered to the transfer roll and applicator roll. Preferably, each wick segment is provided with one or more springs that yieldably urge the segment into contacting engagement with the transfer roll.

DETAILED DESCRIPTION

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments.

Figure 1:
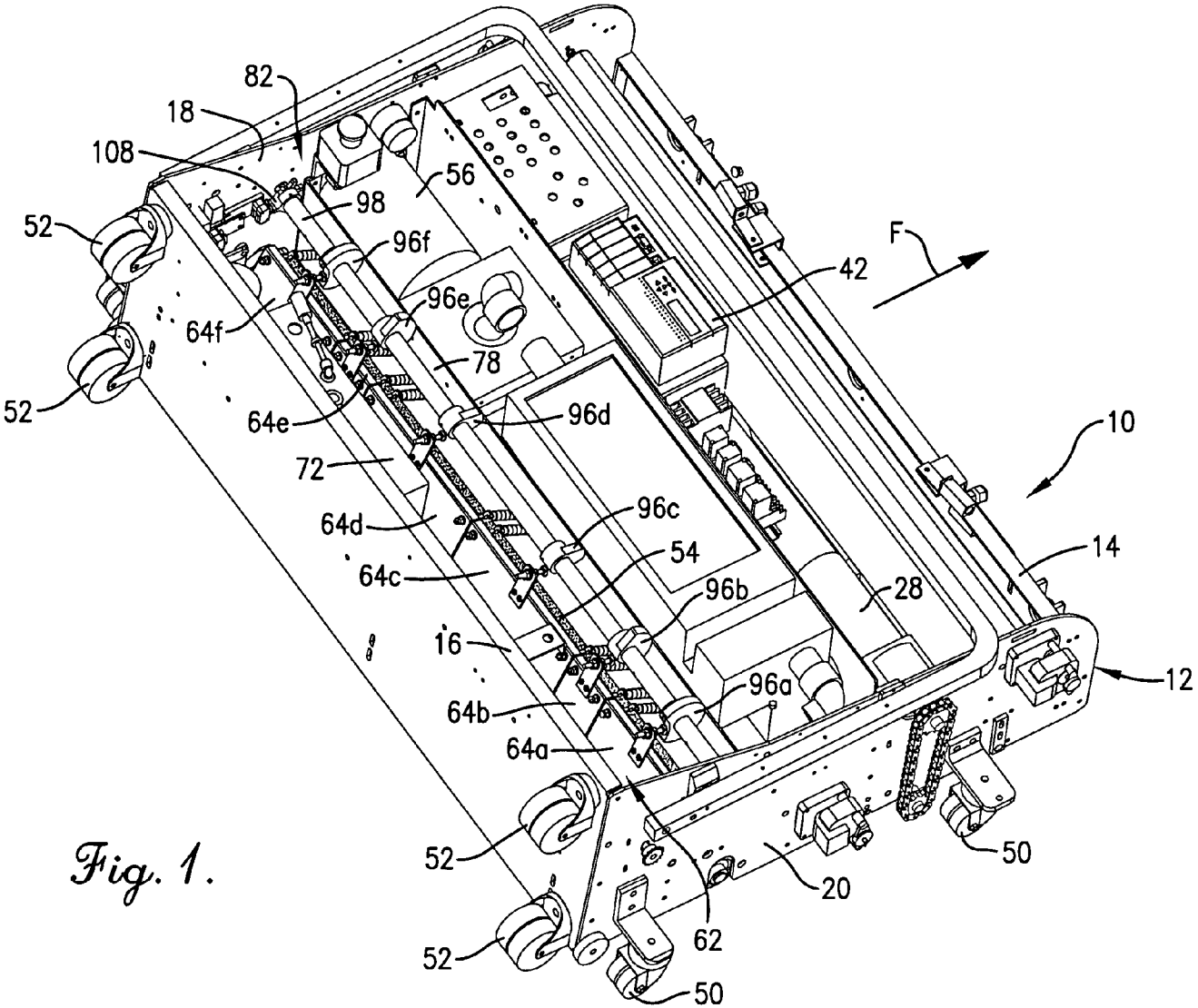
FIG. 1 is a top rear isometric view of a lane maintenance machine constructed in accordance with the principles of the present invention, the cover of the machine being removed to reveal internal details of construction.
Figure 2:
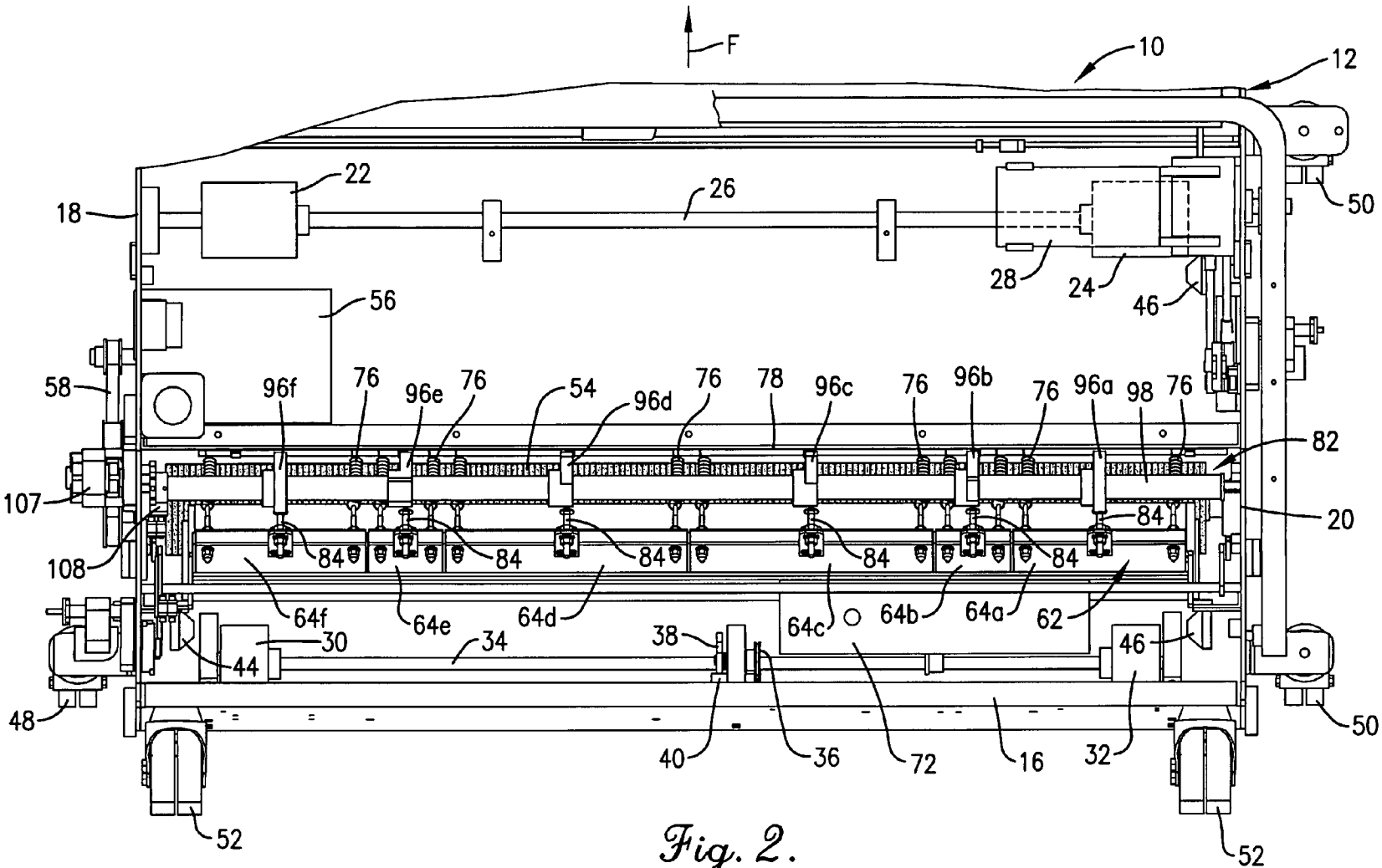
FIG. 2 is a fragmentary top plan view of the machine in FIG. 1 with the cover and other components of the machine removed for clarity.

Referring initially to FIGS. 1 and 2, the lane maintenance machine 10 selected for purposed of illustration is a combination cleaning and conditioning machine wherein cleaning of the lane takes place adjacent the front and middle portion of the machine, while the application of lane dressing to the cleaned lane occurs adjacent the rear of the machine. The forward direction of travel of the machine is indicated by the arrow F in FIGS. 1, 2, 5, and 6. It will be appreciated that the principles of the present invention apply with equal utility to machines without a cleaning function and which are thus only single-purpose lane conditioning machines. A single-purpose conditioning machine is illustrated, for example, in U.S. Pat. No. 5,181,290, the disclosure of which is hereby incorporated by reference into the present specification.

Machine 10 comprises a housing 12 having a front wall 14 (FIG. 1), a rear wall 16, a left sidewall 18, and a right sidewall 20. A pair of forwardly located drive wheels 22 and 24 (FIG. 2) secured to a common transverse shaft 26 are driven by a reversible motor 28 for moving the machine 10 up and down the lane. Adjacent the rear of the machine, a pair of lane distance wheels 30 and 32 (FIG. 2) on a common transverse shaft 34 engage the lane surface to support the rear of housing 12 as the machine moves along the lane. Wheels 30, 32 are driven by contact with the lane surface as drive wheels 22, 24 move the machine along the lane. Thus, shaft 34 is rotated by wheels 30, 32 and such rotation is used to drive a chain and sprocket assembly 36 that rotates a toothed wheel 38. Rotation of toothed wheel 38 is detected by a sensor 40 to send lane distance information to a control system that includes a programmable logic controller 42. Front cone-shaped guide wheels 44 (only one being shown) and rear cone-shaped guide wheels 46 ride within and along the edge of the gutter as the machine moves along the lane whereby to confine the machine to a proper path of travel along the lane surface, while outboard left castor wheels 48 (only one being shown) and outboard right castor wheels 50 hang over into the gutters without contacting the lane surface as the machine moves along the lane. Castor wheels 48, 50 support the machine when it is behind the foul line on the approach area of the lane. The machine may also be upended and supported on castoring transport wheels 52 that project rearwardly from rear wall 16 for the purpose of moving machine 10 to and from the lane area.

Dressing is applied to the lane surface by application apparatus that includes a transversely extending, brush-type applicator roll 54. Applicator roll 54 is rotated in a clockwise direction viewing FIGS. 3, 5, and 6 by a buffer motor 56 (FIGS. 1 and 2) through a belt and pulley assembly 58 that is situated outboard of left sidewall 18. In a preferred embodiment, the application apparatus also includes a metal transfer roll 60 that engages applicator roll 54 at a point on its upper periphery for transferring dressing to applicator roll 54 from the source of such dressing. Transfer roll 60 also rotates in a clockwise direction viewing FIGS. 3, 5, and 6.

Lane dressing is delivered to transfer roll 60 by a pad-type, preferably felt wick 62 having a plurality of wick segments 64 formed therein by a series of transverse cuts in the elongated wick 62 that extend only partially across the body of the wick so as to leave an uncut base margin that interconnects and is common to all of the segments 64. The base margin is denoted by the numeral 66 in FIGS. 5 and 6 and is received within a slightly forwardly inclined trough 68 that extends across the housing 12 for the full length of transfer roll 60. Affixed to the backside of trough 68 is a pilot chamber 70 in fluid communication with the interior of trough 68 via an inlet port (not shown) for the purpose of establishing a constant dressing level within trough 68 by hydraulic pressure. Pilot chamber 70 is supplied dressing by a tank 72 (FIG. 1) in accordance with the principles disclosed in prior U.S. Pat. No. 6,685,778, the entire disclosure of which is hereby incorporated by reference into the present specification.

Figure 5:
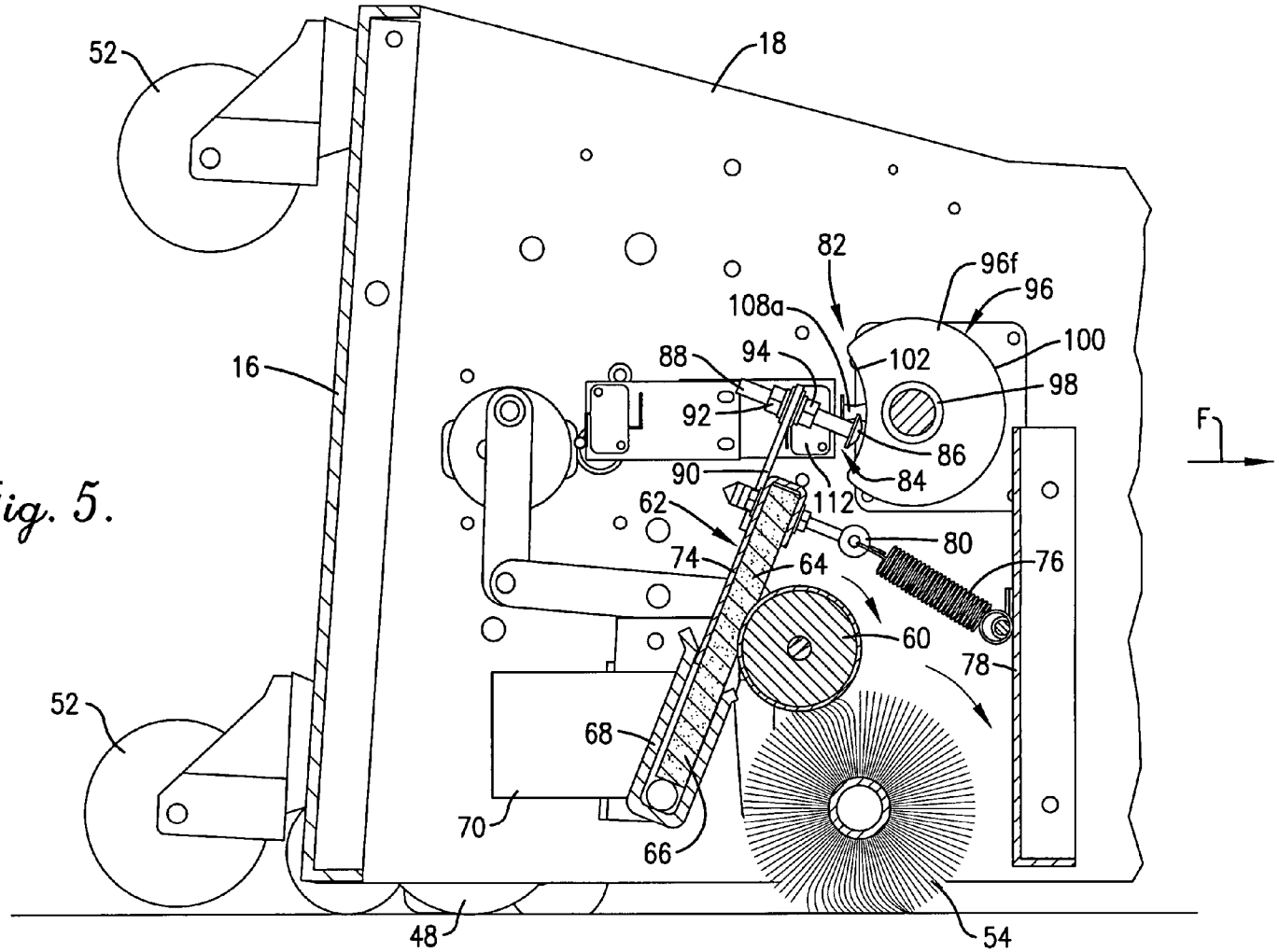
FIG. 5 is an enlarged, fragmentary vertical cross sectional view through the rear of the machine illustrating one of the wick segments in its operating position engaged with the transfer roll.

In the illustrated embodiment, wick 62 is provided with six wick segments 64*a*, 64*b*, 64*c*, 64*d*, 64*e*, and 64*f*, although there may be a greater or smaller number of wick segments depending upon personal choice. Additionally, the wick segments may be any desired size. Each wick segment 64 is provided with a metal jacket 74 that covers the backside of the segment, loops over the top thereof and extends for a short distance down the front side of the segment in order to leave the front of segment 64 substantially open and exposed for contacting engagement with transfer roll 60. At least one tension spring 76, and preferably two, is provided for each wick segment 64 for yieldably biasing the same into an operating position in which the segment 64 is in contacting engagement with transfer roll 60 as illustrated in FIG. 5. Each spring 76 is anchored at one end to an upright partition 78 and at its other end to an eye-bolt 80 projecting forwardly from jacket 74 adjacent the upper front extremity of wick segment 64. The eye-bolts 80 for each wick segment 64 are located in the upper left and right corners thereof so as to position springs 76 for applying a symmetrical pulling action on the wick segments 64, which are inherently flexible as is well known in the art.

Figure 6:
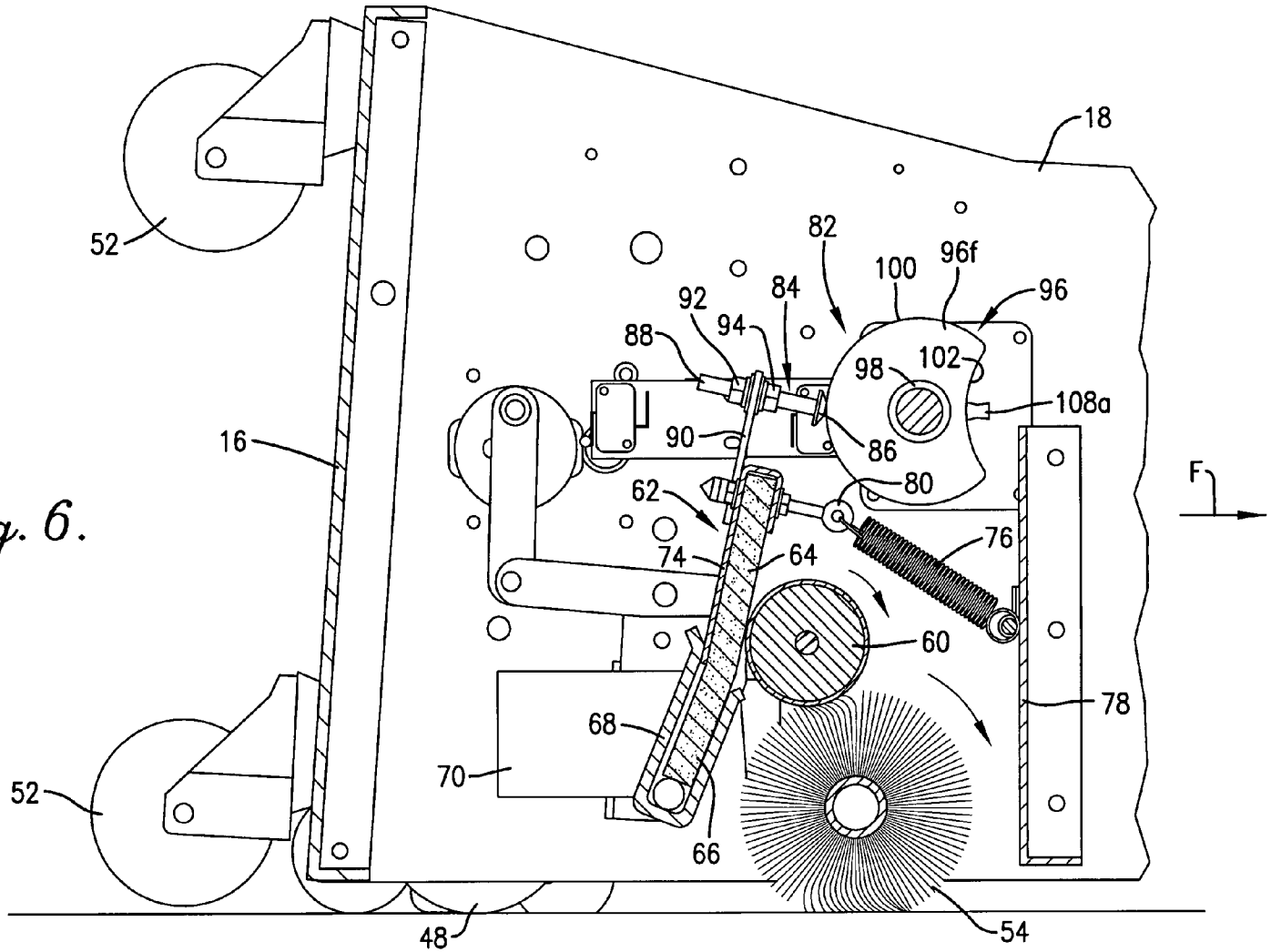
FIG. 6 is an enlarged, fragmentary cross sectional view similar to FIG. 5 but showing the wick section in its standby position disengaged from the transfer roll.

Wick segments 64 are flexed between their operating position of FIG. 5 and a standby position of FIG. 6 by actuating mechanism broadly denoted by the numeral 82. In the operating position wick segments 64 are operable to transfer dressing to transfer roll 60, while in the standby position wick segments 64 are sufficiently out of contact with transfer roll 60 that they are not operable to transfer significant amounts of dressing to transfer roll 60. Among other things, mechanism 82 includes a cam follower 84 on each of the wick segments 64. Such follower 84 has a fowardly disposed, rounded cam-engaging head 86 and a shank 88 that is secured to a generally upright, rigid mounting tab 90 affixed to the backside of jacket 74. Tab 90 is positioned approximately equidistant from opposite lateral extremities of wick segment 64 as illustrated, for example, in FIG. 3. Preferably, cam follower 84 is in the nature of a screw or the like that passes through mounting tab 90 and is secured thereto by a pair of oppositely disposed clamping nuts 92 and 94 on opposite fore-and-aft sides of tab 90. The extent of projection of follower 84 forwardly of tab 90 can be adjusted by appropriately loosening and retightening of nuts 92, 94.

Actuating mechanism 82 further includes a cam 96 for each of the followers 84. In the illustrated embodiment, six cams 96 are provided and are designated 96*a*, 96*b*, 96*c*, 96*d*, 96*e*, and 96*f*. All of the cams 96 are secured to a common cam shaft 98 that spans the machine and is supported for rotation by the opposite side walls 18 and 20. Although each of the cams 96 is adjustably positioned along cam shaft 98 and is rotatably adjustable about the circumference of cam shaft 98, it is contemplated that once the desired position for each cam 96 is determined on cam shaft 98, such cam will become essentially permanently disposed in such position.

It will be noted that the two outboard cams 96*a* and 96*f* are identical to one another, while the next two inboard cams 96*b* and 96*e* are identical to one another, as are the center two cams 96*c* and 96*d*. In one preferred embodiment outboard cams 96*a* and 96*f* are generally circular, each having a constant radius lobe portion covering approximately 265° of its periphery to present a 265° cam surface 100 that is disposed for operating engagement with cam follower 86. The remaining portion of each cam 96*a*, 96*f* comprises a cutout portion 102 of such depth that no cam actuating surface for follower 84 is presented when cam 96*a* or 96*f* is in alignment with follower 84 as illustrated in FIG. 5.

Figure 3:
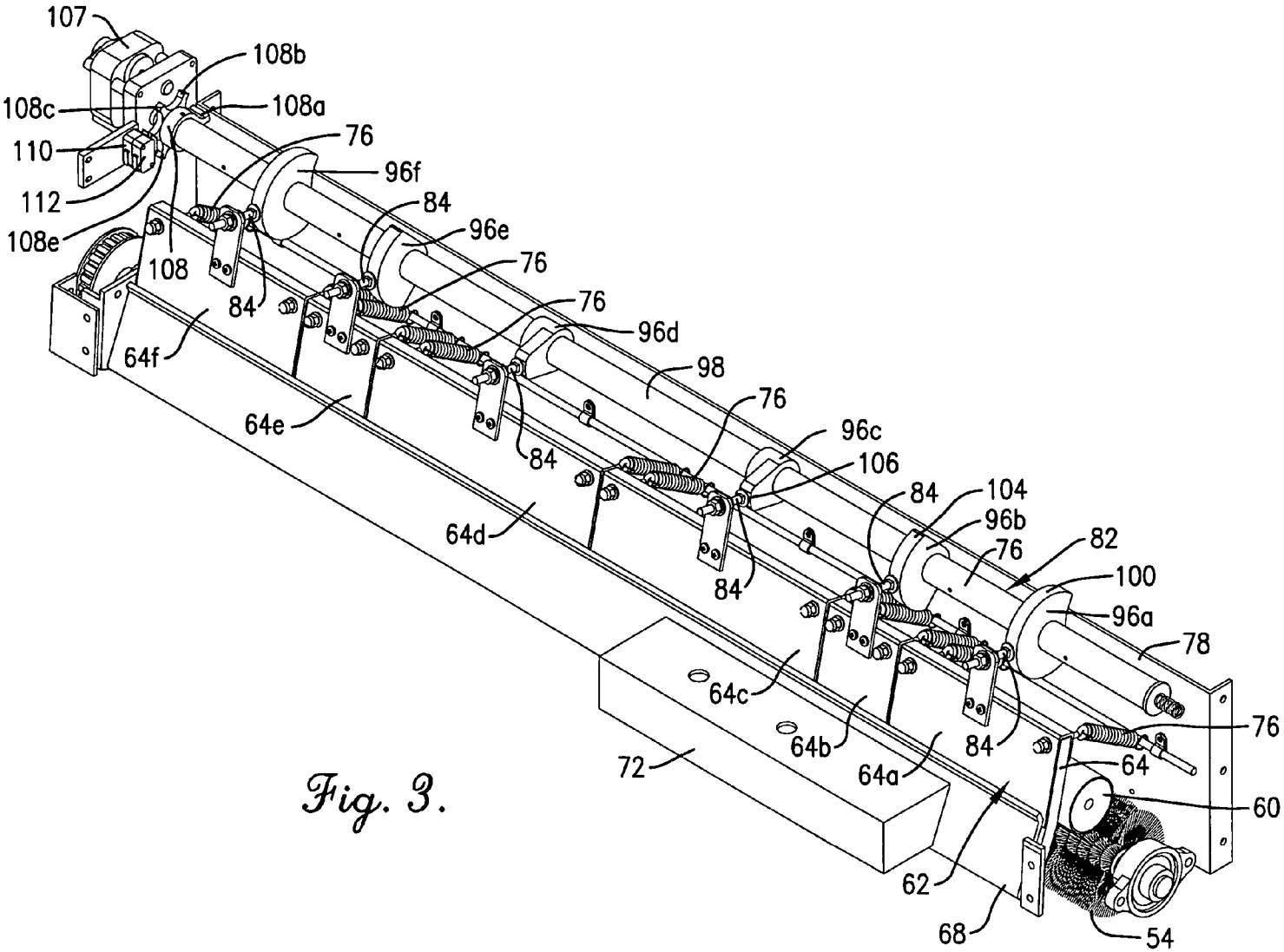
FIG. 3 is a rear isometric view of the dressing delivery and application portion of the machine, the wick segments being illustrated in standby positions disengaged from the transfer roll by the cams of the wick actuating mechanism.

Preferably, the next two inboard cams 96*b* and 96*e* are generally sector-shaped as illustrated best in FIG. 3. The lobed portion of cams 96*b*, 96*e* extends for approximately 148° so as to present a cam actuating surface 104 of that same magnitude. The remainder of each cam 96*b*, 96*e* is sufficiently recessed with respect to cam actuating surface 104 as to avoid engagement with the corresponding follower 84.

The two innermost cams 96*c* and 96*d* are preferably provided with the smallest amount of actuating lobe so as to correspondingly present a small, relatively short cam surface 106. Preferably, cam surface 106 is on the order of approximately 21° of the 360° rotational cycle of the cam. It will be noted that, in the most preferred embodiment, all of the cams 96*a-f* are symmetrically disposed with respect to one another. In other words, when center cams 96*c* and 96*d* are engaging their followers 84, the cams 96*b*, 96*e* and 96*a*, 96*f* are likewise engaging their followers at the mid-points of the respective cam surfaces 104 and 100.

Cam shaft 98 is driven by an indexing motor 107 at the left end thereof. It is contemplated that motor 107 will index or drive cam shaft 98 through successive partial revolutions of predetermined magnitudes depending upon the distance the machine has traveled down the lane. In a preferred embodiment, motor 107 drives cam shaft 98 in successive 60° increments of rotation, stopping after each 60° of travel. Preferably, motor 107 is provided with a positive brake system built into the motor such that there is no over-travel of cam shaft 98 when motor 107 shuts off. One suitable such motor is available from Merkle-Korff Industries of Des Plaines, Ill. as Model No. S-5062.

Thus, motor 107 is operably connected to controller 42 which periodically closes a circuit to turn on motor 107 in accordance with a pre-programmed distance of travel of the machine along the bowling lane. A toothed hub 108 at the left end of cam shaft 98 has six teeth 108*a*, 108*b*, 108*c*, 108*d*, 108*e*, and 108*f* (not shown) at 60° intervals for actuating a position switch 110 after each 60° of indexing rotation of cam shaft 98. Position switch 110 is connected in the electrical circuit associated with motor 107 and is operable to open such circuit and thereby turn off motor 107 when actuated by a tooth 108*a*-108*f*. The first tooth 108*a* is wider than the rest of the teeth for actuating a second "home" switch 112 when tooth 108*a* is in alignment with the two switches 110, 112 as illustrated in FIGS. 1, 2, and 5. This may be considered the "home" or "zero" position of cam shaft 98 and is present when the machine is at the foul line at the beginning or end of its run up and down the lane. Switch 112 is also utilized to reset cam shaft 98 to the "zero" or "home" position in the event that the machine is unplugged in the middle of a cycle and then plugged back in. In the unlikely event cam shaft 98 fails to rotate during an intended operating cycle, such error can be detected by the fact that switches 110, 112 are not actuated in the normal manner. Thus, the cam-operated design of the present invention lends itself to close monitoring by the user.

OPERATION

The pattern of lane dressing applied to the bowling lane surface is determined by the manner in which controller 42 is programmed. Generally speaking, whether or not dressing is applied to a certain width of boards of the lane depends upon whether the wick segment 64 corresponding to that particular group of boards is engaged with transfer roll 60. Although there is a certain amount of residual dressing left on the transfer and applicator rolls even after a wick segment has been disengaged, no additional dressing is delivered by that particular wick segment. Thus, the pattern both across the lane and down the lane is dependent upon which of the wick segments 64*a-f* are in engagement with transfer roll 60, and when.

In the illustrated embodiment, there is no ability to vary the dressing applied to the left side of the center of the lane versus that applied to the right side of the lane. Cams 96*a* and 96*f* actuate their corresponding outside wick segments 64*a*, 64*f* in unison, while cams 96*b*, 96*e* operate the track wick segments 64*b*, 64*e* in unison, and cams 96*c*, 96*d* operate the inside wick segments 64*c*, 64*d* in unison. If left/right control is desired, cam shaft 98 could be separated into two separate shafts, each provided with its own indexing motor, toothed hub and control switches.

In the illustrated embodiment, when the machine is ready to start down the lane at the foul line, the cams 96 are disposed as illustrated in FIGS. 1, 2, and 5 wherein all wick segments 64*a-f* are in their operating positions engaging transfer roll 60. Toothed hub 108 is in the home position with wide tooth 108*a* depressing both switches 110 and 112. Thus, as the machine starts down the lane, dressing is applied to the lane surface across the full width thereof by applicator roll 54.

After the machine has traveled five feet down the lane, for example, indexing motor 107 is actuated by controller 42 to rotate cam shaft 98 in a clockwise direction viewing FIG. 5. After 60° of rotation, the tooth 108*b* comes into engagement with switch 110, causing motor 107 to turn off. Such rotation causes the lobed portion of cams 96*a* and 96*f* to come into engagement with the corresponding cam followers 84 of outside wick segments 64*a* and 64*f* and flex such wick segments rearwardly off transfer roll 60 into the standby position of FIG. 6. Thus, dressing is no longer applied to the outside boards corresponding to outside wick segments 64*a* and 64*f* as the machine continues down the lane.

After the machine has traveled a total of fifteen feet down the lane, for example, controller 42 again energizes motor 107 to rotate cam shaft 98 through the next cycle of rotation. Such rotation continues until the next tooth 108*c* comes into engagement with switch 110. As a result of this rotation, the lobes of cams 96*b* and 96*e* come into operating engagement with the followers 84 of track wick segments 64*b* and 64*e*, causing such segments to flex rearwardly off transfer roll 60. Thus, dressing is no longer applied to the boards corresponding to track wick segments 64*b* and 64*e*, as well as the boards corresponding to wick segments 64*a* and 64*f*, as the machine continues down the lane toward the pin deck.

Figure 4:
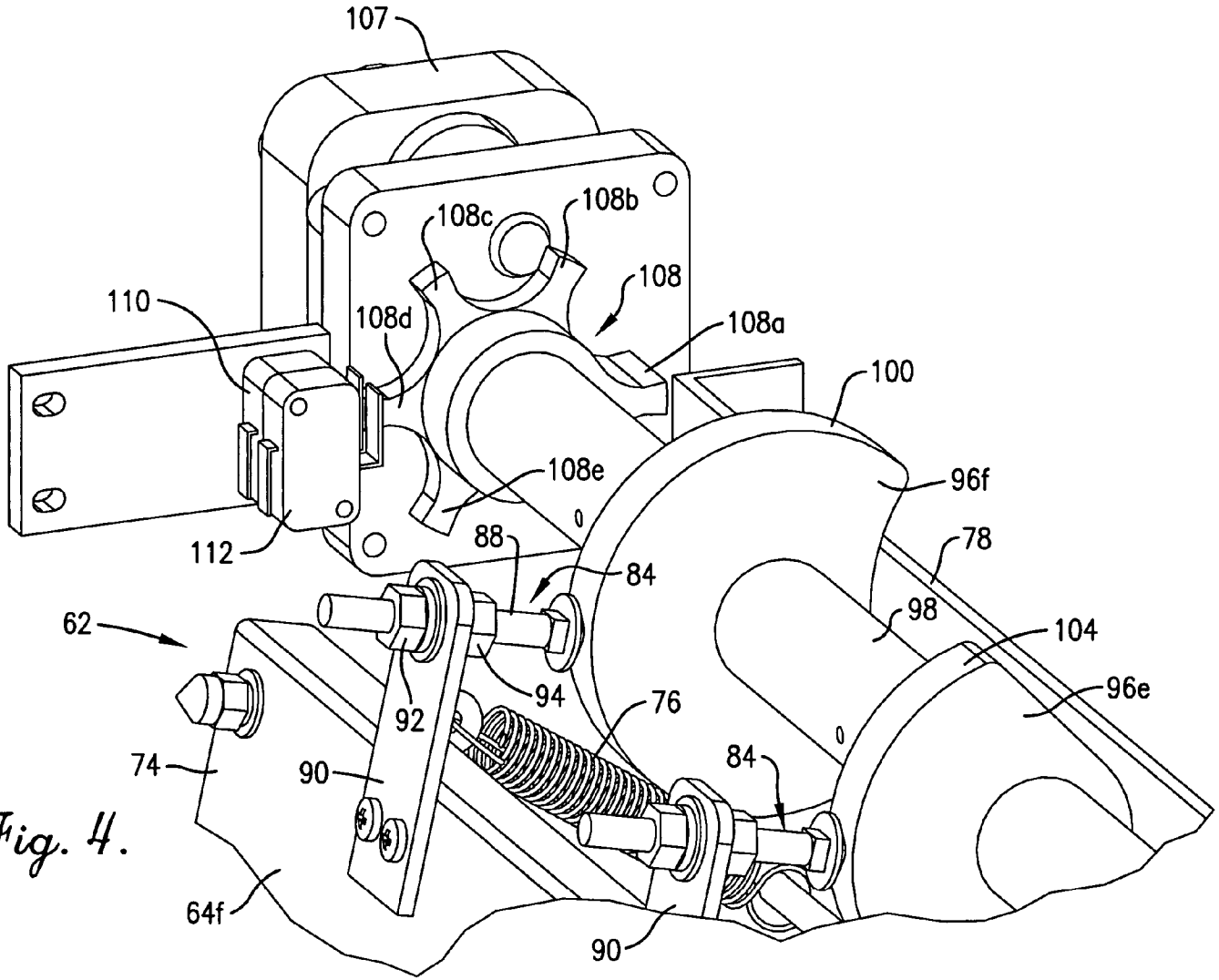
FIG. 4 is an enlarged, fragmentary isometric view of the indexing motor and related mechanism at one end of the cam actuating mechanism for the wick segments of the machine.

After the machine has traveled a total of twenty-five feet down the lane, for example, controller 42 again energizes motor 107 to index cam shaft 98 through a third 60° segment of rotational travel. This brings tooth 108*d* into engagement with switch 110 and stops motor 107. It also causes the lobed portions of cams 96*c* and 96*d* to come into operating engagement with the followers 84 of inside wick segments 64*c* and 64*d* so as to flex those segments rearwardly off transfer roll 60 to their standby positions. Consequently, from this point on as the machine continues down the lane, no dressing is applied by any of the wick segments as all of them are disengaged from transfer roll 60 as illustrated in FIGS. 3, 4, and 6.

Once the machine reaches the pin deck area, it stops, and drive motor 28 reverses to move the machine in reverse back toward the foul line. Although applicator roll 54 continues to rotate during this portion of machine travel, no additional dressing is applied until the machine reaches the twenty-five foot mark. At that point, controller 42 actuates motor 107 to rotate cam shaft 98, which causes the lobes of inside cams 96*c*, 96*d* to move out from under followers 84 of inside wick segments 64*c*, 64*d*. Springs 76 of inside segments 64*c*, 64*d* thereupon flex those segments forwardly into engagement with transfer roll 60, and dressing is once again applied to the inside boards of the lane. Motor 107 is turned off when tooth 108*e* comes into engagement with switch 110.

When the machine reaches the fifteen foot mark, motor 107 comes on again to rotate cam shaft 98 and cause track wick segments 96*b*, 96*e* to come back into engagement with transfer roll 60 along with inside wick segments 96*c*, 96*d*. When tooth 108*f* comes into engagement with switch 110, motor 107 shuts off. The machine thus applies dressing to both the center of the lane and the track sections thereof as reverse travel continues.

When the machine reaches the five foot mark, motor 107 turns on to rotate cam shaft 98 until wide tooth 108*a* engages switches 110 and 112. Such rotation causes the outside wick sections 96*a*, 96*f* to come into engagement with transfer roll 60 and commence the delivery of dressing thereto. Thus, from this point on back to the foul line, all wick segments are engaging transfer roll 60 and dressing is applied across the entire width of the lane.

It will be appreciated that the number of wick segments used in the machine is a matter of choice. Depending upon the extent of board-by-board control that is desired across the lane, a greater or lesser number of wick segments (and corresponding cams, followers, and hub teeth) are utilized. It is also to be noted that buffer motor 56 is preferably a constant speed motor such that applicator roll 54 always rotates at the same speed. On the other hand, lane drive motor 28 is preferably a variable speed motor such that the amount of dressing applied to the lane surface during a particular segment of travel can be varied by varying the speed of drive motor 28. The faster the machine moves along the lane during its application cycle, the less dressing will be applied by applicator roll 54 per unit area of lane surface.

The inventor(s) hereby state(s) his/their intent to rely on the Doctrine of Equivalents to determine and assess the reasonably fair scope of his/their invention as pertains to any apparatus not materially departing from but outside the literal scope of the invention as set out in the following claims.

The invention claimed is:

1. In a bowling lane maintenance machine having at least one wick segment that is shiftable between an operating position wherein the wick segment delivers lane dressing to applicator apparatus that applies dressing to the surface of a lane as the machine moves along the lane and a standby position wherein the wick segment does not deliver dressing to the applicator apparatus, the improvement comprising:

a cam follower associated with said wick segment; and a movable cam engageable with said follower in a manner to cause shifting of the wick segment between said positions upon movement of the cam, further comprising a spring operably coupled with said wick segment for yieldably urging the wick segment toward one of said positions, said cam being operable to shift the wick segment to the other of said positions, said spring yieldably urging the wick segment toward the operating position, said cam having a first cam surface configured for moving the wick segment into said standby position and a second cam surface configured for allowing the spring to move the wick segment into the operating position.

2. In a bowling lane maintenance machine as claimed in claim 1, said applicator apparatus including a transfer roll disposed for engagement with said wick segment when the wick segment is in said operating position and an applicator roll engageable with the lane surface, said transfer roll being in engagement with the applicator roll for transferring dressing thereto from the wick segment.

3. In a bowling lane maintenance machine having at least one wick segment that is shiftable between an operating position wherein the wick segment delivers lane dressing to applicator apparatus that applies dressing to the surface of a lane as the machine moves along the lane and a standby position wherein the wick segment does not deliver dressing to the applicator apparatus, the improvement comprising:

a cam follower associated with said wick segment; and a movable cam engageable with said follower in a manner to cause shifting of the wick segment between said positions upon movement of the cam, said cam being fixed to a rotatable cam shaft for rotation therewith relative to the follower, further comprising a drive motor operably coupled with said cam shaft and a control system operably connected to said motor for actuating the same in accordance with the distance traveled by the machine along the lane, said cam being rotatably adjustably secured to said shaft for adjusting the position of the cam about the shaft.

4. In a bowling lane maintenance machine as claimed in claim 3, said applicator apparatus including a transfer roll disposed for engagement with said wick segment when the wick segment is in said operating position and an applicator roll engageable with the lane surface, said transfer roll being in engagement with the applicator roll for transferring dressing thereto from the wick segment.

5. In a bowling lane maintenance machine having at least one wick segment that is shiftable between an operating position wherein the wick segment delivers lane dressing to applicator apparatus that applies dressing to the surface of a lane as the machine moves along the lane and a standby position wherein the wick segment does not deliver dressing to the applicator apparatus, the improvement comprising:

a cam follower associated with said wick segment; and a movable cam engageable with said follower in a manner to cause shifting of the wick segment between said positions upon movement of the cam, further comprising a series of wick segments and a corresponding series of cams and cam followers, there being a cam follower and a cam for each of said wick segments.

6. In a bowling lane maintenance machine as claimed in claim 5, said cams being fixed to a common rotatable cam shaft, further comprising a motor operable during each actuation thereof to drive the cam shaft through a pre-determined amount of rotational movement, said motor being connected to a control system operable to actuate the same through successive actuations in accordance with the distance traveled by the machine along the lane.

7. In a bowling lane maintenance machine as claimed in claim 6, said cams being so configured relative to one another as to permit shifting of different ones of the wick segments during different actuations of the motor.

8. In a bowling lane maintenance machine as claimed in claim 6, further comprising a spring operably coupled with each wick segment for yieldably urging the wick segment toward one of its positions.

9. In a bowling lane maintenance machine as claimed in claim 5, said applicator apparatus including a transfer roll disposed for engagement with said wick segment when the wick segment is in said operating position and an applicator roll engageable with the lane surface, said transfer roll being in engagement with the applicator roll for transferring dressing thereto from the wick segment.

* * * * *